US011156957B2

(12) United States Patent
Okawa et al.

(10) Patent No.: US 11,156,957 B2
(45) Date of Patent: Oct. 26, 2021

(54) IMAGE FORMING APPARATUS WITH ELECTRICAL CONNECTION LINKED TO OPENING AND CLOSING OF COVER

(71) Applicant: CANON KABUSHIKI KAISHA, Tokyo (JP)

(72) Inventors: Yuichiro Okawa, Tokyo (JP); Shunsuke Hijikata, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/985,646

(22) Filed: Aug. 5, 2020

(65) Prior Publication Data

US 2021/0063940 A1 Mar. 4, 2021

(30) Foreign Application Priority Data

Aug. 29, 2019 (JP) ..... JP2019-156387

(51) Int. Cl.
*G03G 21/00* (2006.01)
*G03G 21/18* (2006.01)
(Continued)

(52) U.S. Cl.
CPC ..... *G03G 21/1867* (2013.01); *G03G 15/5004* (2013.01); *G03G 15/80* (2013.01);
(Continued)

(58) Field of Classification Search
CPC ..... G03G 15/80; G03G 15/5004; G03G 21/1633; G03G 21/1652; G03G 21/1867;
(Continued)

(56) References Cited

U.S. PATENT DOCUMENTS 7,761,024 B2 * 7/2010 Imaizumi ..... G03G 21/1623 399/90
8,571,434 B2 * 10/2013 Kakitani ..... G03G 21/1633 399/90
(Continued)

FOREIGN PATENT DOCUMENTS

JP 10239933 A * 9/1998
JP 2010224117 A * 10/2010
(Continued)

*Primary Examiner* — Robert B Beatty
(74) *Attorney, Agent, or Firm* — Venable LLP

(57) ABSTRACT

An image forming apparatus includes a door; an electric power source substrate for supplying electric power to an object detachably mounted through the door and provided with an electrical contact; an electroconductive member having an apparatus contact connected with the electric power source substrate; an element movable between a contacting position for contacting the apparatus contact and the electrical contact portion with each other and a spacing position for spacing them; a link connecting the door and the element to move the element to the contacting position with door closing and moving the element to the spacing position with door opening; and an operating portion movable with the element moving to the contacting position to connect an electroconductive path between the apparatus contact of the electroconductive member and the electric power source substrate, the operating portion being movable with the element moving to the spacing position to disconnect the path.

8 Claims, 14 Drawing Sheets

(51) Int. Cl.
*G03G 15/00* (2006.01)
*G03G 21/16* (2006.01)

(52) U.S. Cl.
CPC ..... *G03G 21/1633* (2013.01); *G03G 21/1652* (2013.01); *G03G 2221/166* (2013.01); *G03G 2221/1687* (2013.01)

(58) Field of Classification Search
CPC ..... G03G 2221/166; G03G 2221/2221; G03G 2221/1684; G03G 2221/1687; G03G 2221/169; G03G 2221/1869
USPC ..... 399/88, 111
See application file for complete search history.

(56) References Cited

U.S. PATENT DOCUMENTS

| | | | | |
|---|---|---|---|---|
| 2011/0116833 | A1* | 5/2011 | Maeda | G03G 21/1867 399/112 |
| 2013/0022367 | A1 | 1/2013 | Choi | |
| 2018/0052423 | A1* | 2/2018 | Hwang | G03G 21/1867 |
| 2019/0041792 | A1* | 2/2019 | Kishi | G03G 21/1857 |

FOREIGN PATENT DOCUMENTS

| | | |
|---|---|---|
| JP | 2003-177650 | 6/2013 |
| JP | 2014-521125 | 8/2014 |

* cited by examiner (a)

(b)

IMAGE FORMING APPARATUS WITH ELECTRICAL CONNECTION LINKED TO OPENING AND CLOSING OF COVER

FIELD OF THE INVENTION AND RELATED ART

The present invention relates to an image forming apparatus which forms an image by supplying such an object as a removably installable cartridge in its main assembly, which is to be supplied with electric power, with the electric power from its electric power circuit board by way of an electrically conductive passage.

It has been one of the common practices in the field of an image forming apparatus which uses an electrophotographic image formation process, to employ a cartridge system, which integrally places a photosensitive member, and processing means for processing the photosensitive member, in a cartridge which can be removably installable in the main assembly of an image forming apparatus.

In order for a cartridge in an image forming apparatus such as the one described above to be supplied with electric power, it is necessary that after the installation of the cartridge into the main assembly of an image forming apparatus, the electrical contacts with which the cartridge is provided are in contact with the electrical contacts with which the main assembly of the image forming apparatus is provided.

As the methods for assuring that after the installation of an image formation cartridge into the main assembly of an image forming apparatus, the electrical contacts of the cartridge remain in contact with the electrical contacts of the main assembly, those disclosed in JPs. 2003-177650, and 2014-521125 have been known. According to them, the image forming apparatus is provided with a door (cover) which can be opened or closed relative to the main assembly of the apparatus. Further, the image forming apparatus is structured so that as the door is opened or closed, the electric contacts of the cartridge are connected to, or separated from, the electric contacts of the main assembly of the apparatus by the movement of the door.

In the case of the structural arrangement described above, as the door is opened, the electrical contacts of the main assembly are separated from the electrical contacts of the cartridge. However, the electric power circuit board with which the main assembly of the apparatus is provided, remain in contact with the above-mentioned electrical contacts of the main assembly, by way of electrically conductive members. Therefore, there has been the problem that there is high probability that as the door is opened, the electrical power circuit board will be destroyed by ESD (electrostatic discharge) from the electrical contacts on the main assembly side, by way of the electrically conductive members.

SUMMARY OF THE INVENTION

Accordingly, an object of the present invention is to reduce an image forming apparatus in the possibility that as the door (cover) of the image forming apparatus is opened, the electrical power circuit board of the main assembly of the image forming apparatus will be damaged by ESD (electrostatic discharge).

According to an aspect of the present invention, there is provided an image forming apparatus comprising an opening/closing member provided rotatably relative to a main assembly of said image forming apparatus and movable between an open position for opening an opening provided in said main assembly, and a closing position for closing the opening; an electric power source substrate configured to supply electric power to an object which is detachably mounted to said main assembly through the opening and which is to be supplied with electric power, wherein the object is provided with an electrical contact; an electroconductive member provided with a main assembly side contact portion connected with said electric power source substrate; a movable member movable between a contacting position for contacting said main assembly side contact portion and said electrical contact portion with each other and a spacing position for spacing them from each other; a link mechanism connecting said opening/closing member and said movable member with each other, said link mechanism being capable of moving said movable member to the contacting position in interrelation with a closing operation of said opening/closing member and capable of moving said movable member to the spacing position in interrelation with and opening operation of said opening/closing member; and an operating portion movable with said movable member moving to the contacting position to connect at least a part of an electroconductive path between said main assembly side contact portion of said electroconductive member and said electric power source substrate, said operating portion being movable with said movable member moving to the spacing position to disconnect at least a part of an electroconductive path between said main assembly side contact portion of said electroconductive member and said electric power source substrate.

Further features of the present invention will become apparent from the following description of exemplary embodiments with reference to the attached drawings.

Figure 7:
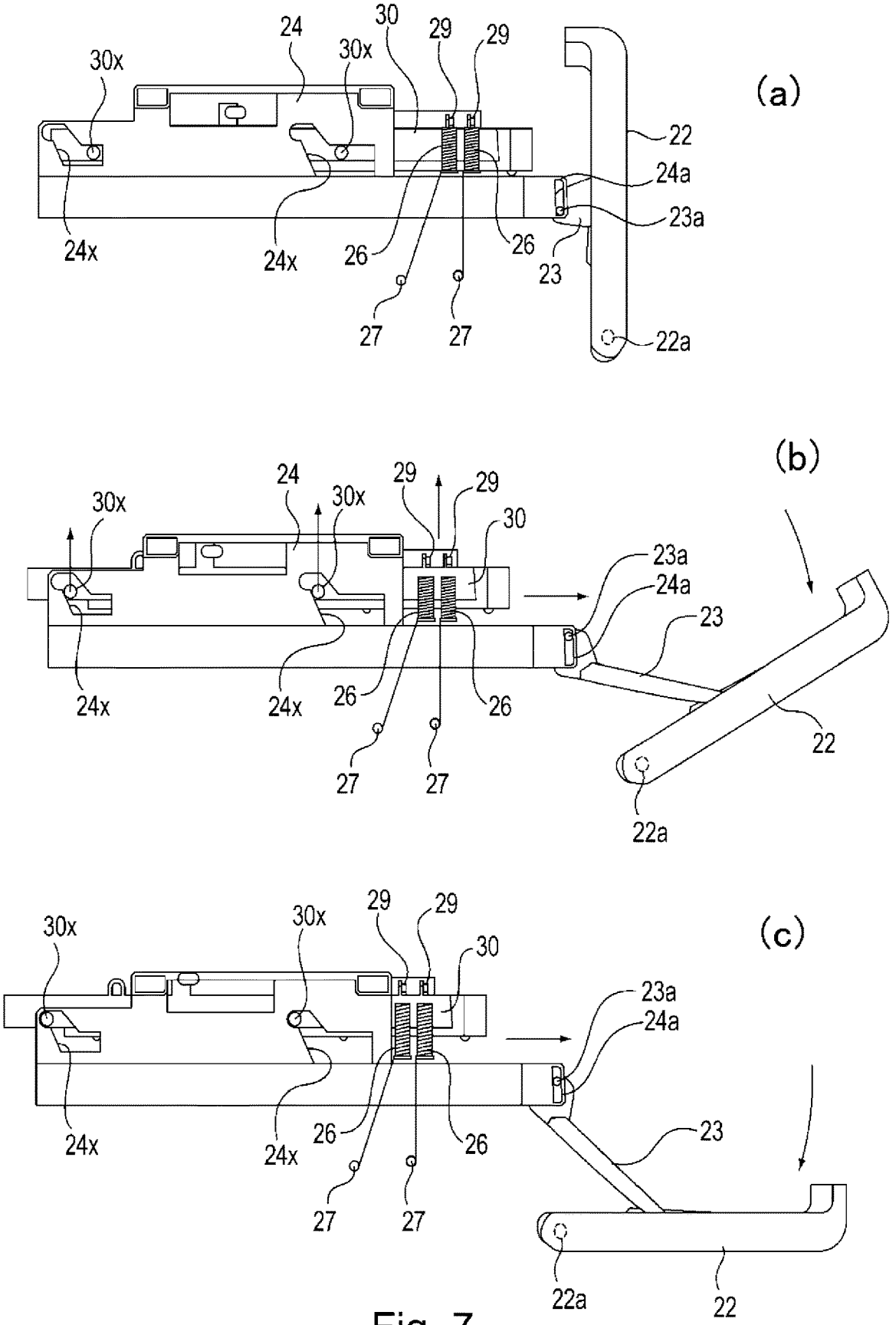

Part (a) of FIG. 7, part (b) of FIG. 7 and part (c) of FIG. 7 are schematic side views of the portions of the image forming apparatus in the first embodiment, which are closely related to the present invention, when the front door is remaining closed, being opened, and open, respectively.

Figure 8:
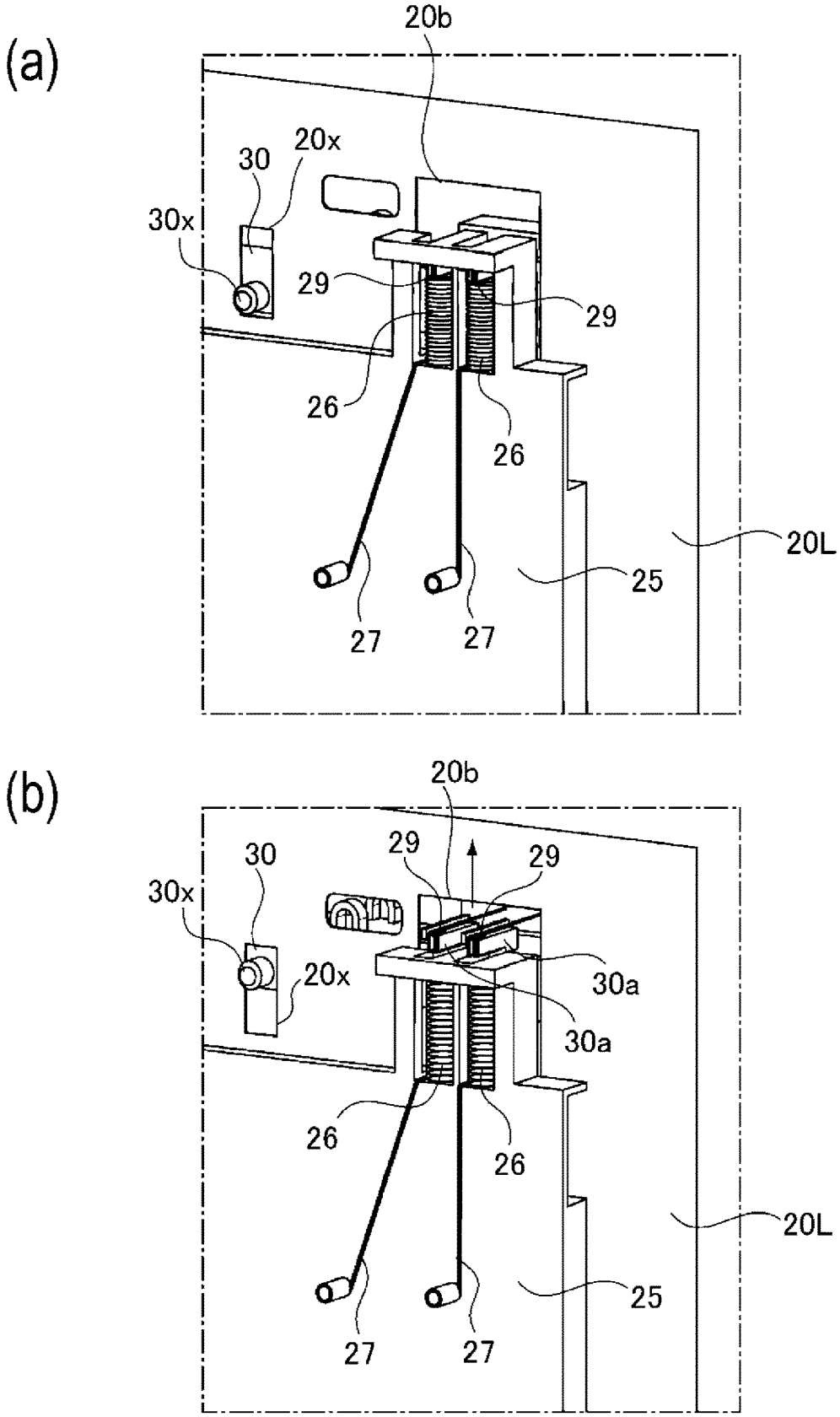

Part (a) of FIG. 8 and part (b) of FIG. 8 are perspective views of the intermediary contact springs, and their adjacencies, of the image forming apparatus in the first embodiment, when the intermediary contact springs are in contact, and are not in contact, respectively, with the connective lines, respectively.

Figure 9:
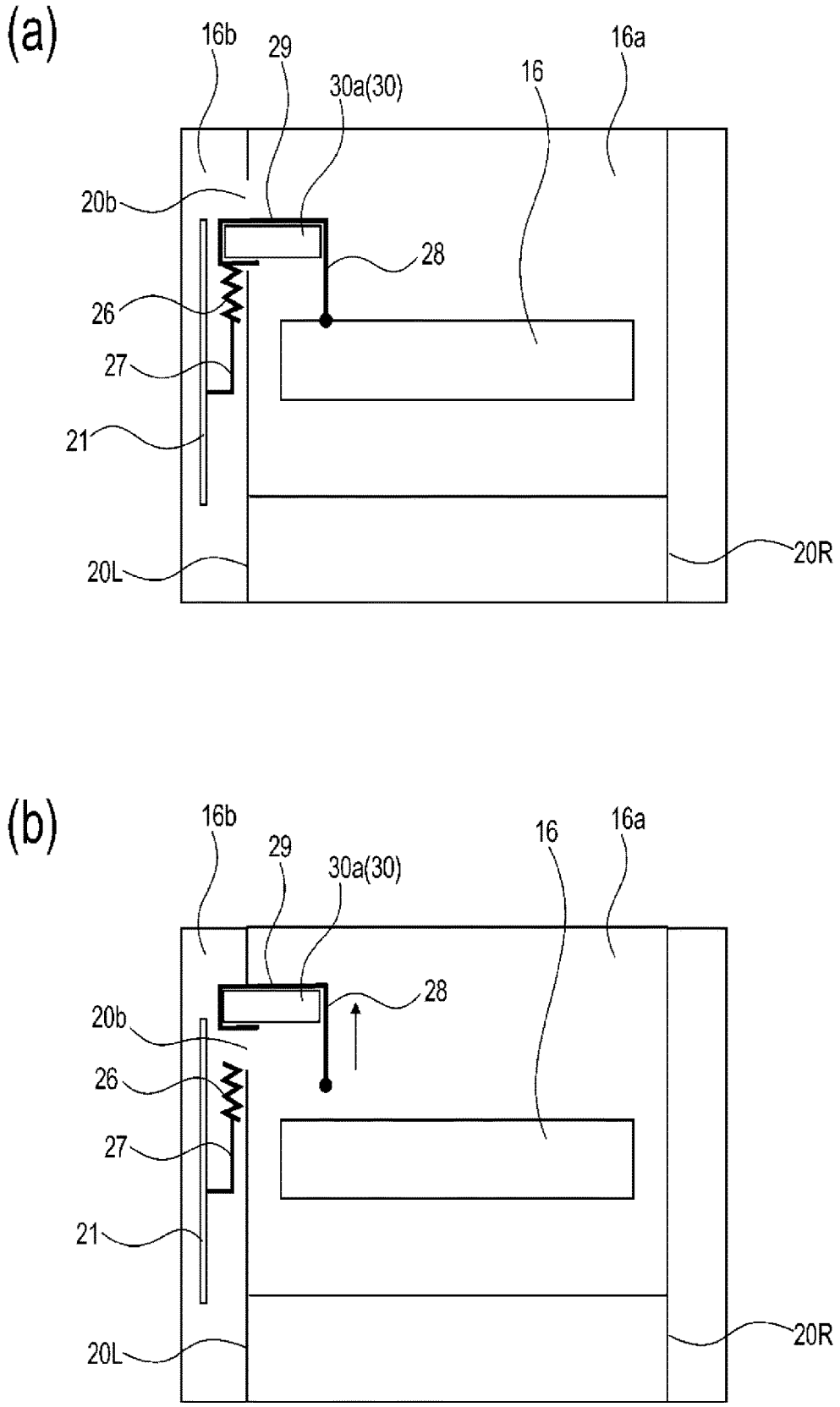

Part (a) of FIG. 9 and part (b) of FIG. 9 are schematic sectional views of one of the intermediary contact springs, and its adjacencies, of the image forming apparatus in the first embodiment, when the intermediary contact spring is in contact, and is not in contact, respectively, with the connective line.

Figure 10:
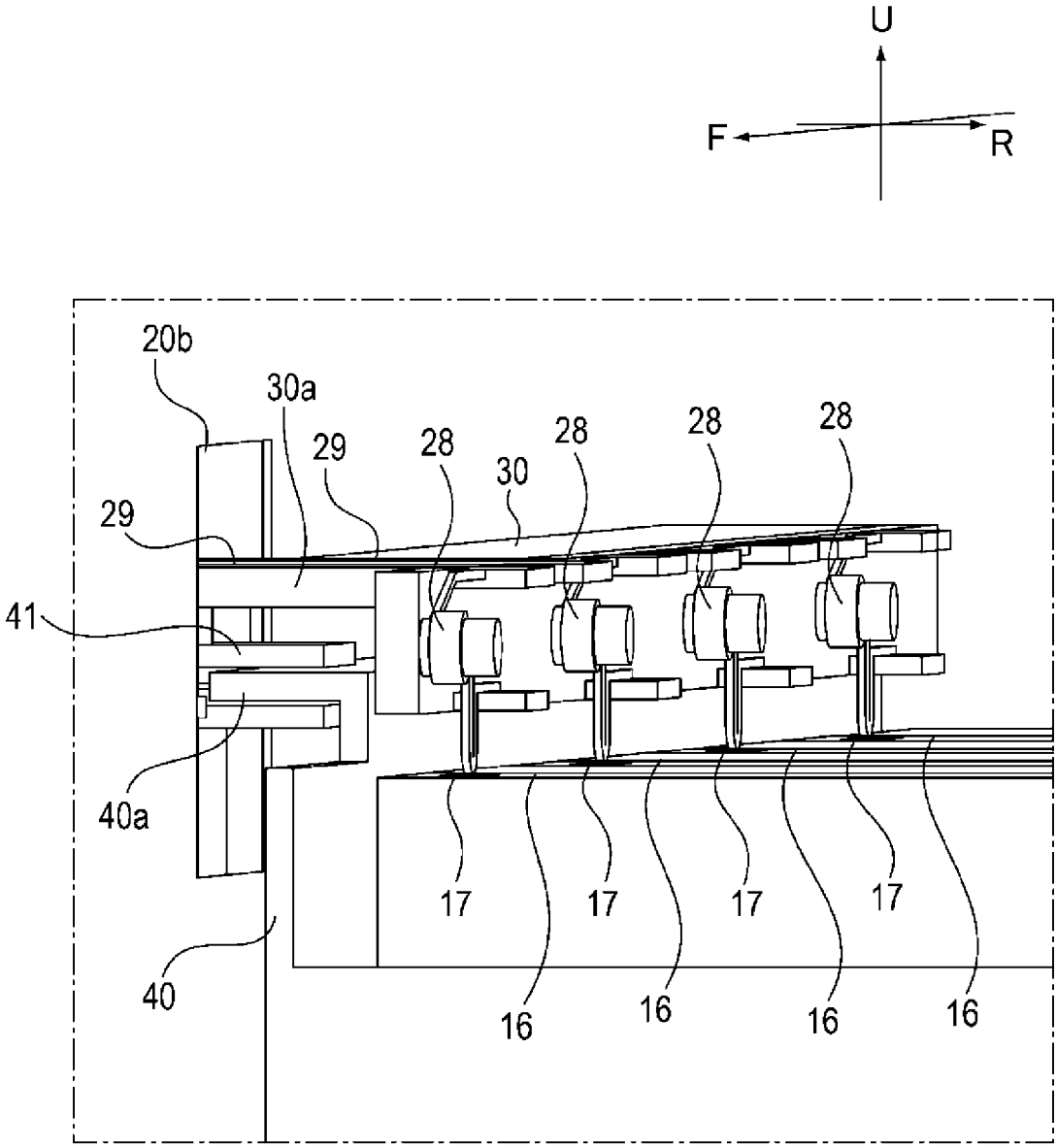

FIG. 10 is a perspective view of the image forming apparatus in the second embodiment of the present invention, when the front door of the apparatus is remaining closed.

Figure 11:
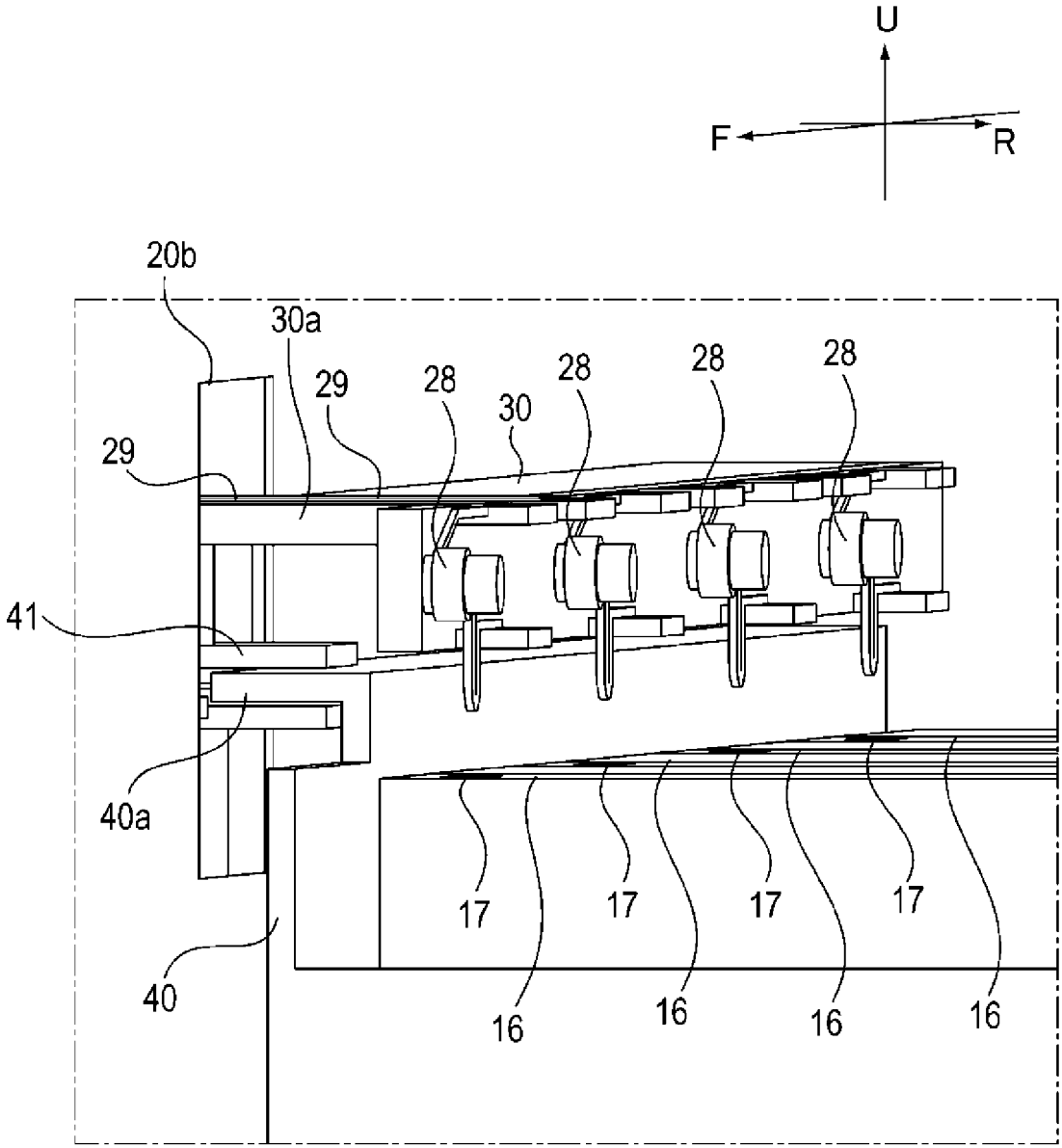

FIG. 11 is a perspective view of the image forming apparatus in the second embodiment, when the front door of the apparatus is open.

Figure 12:
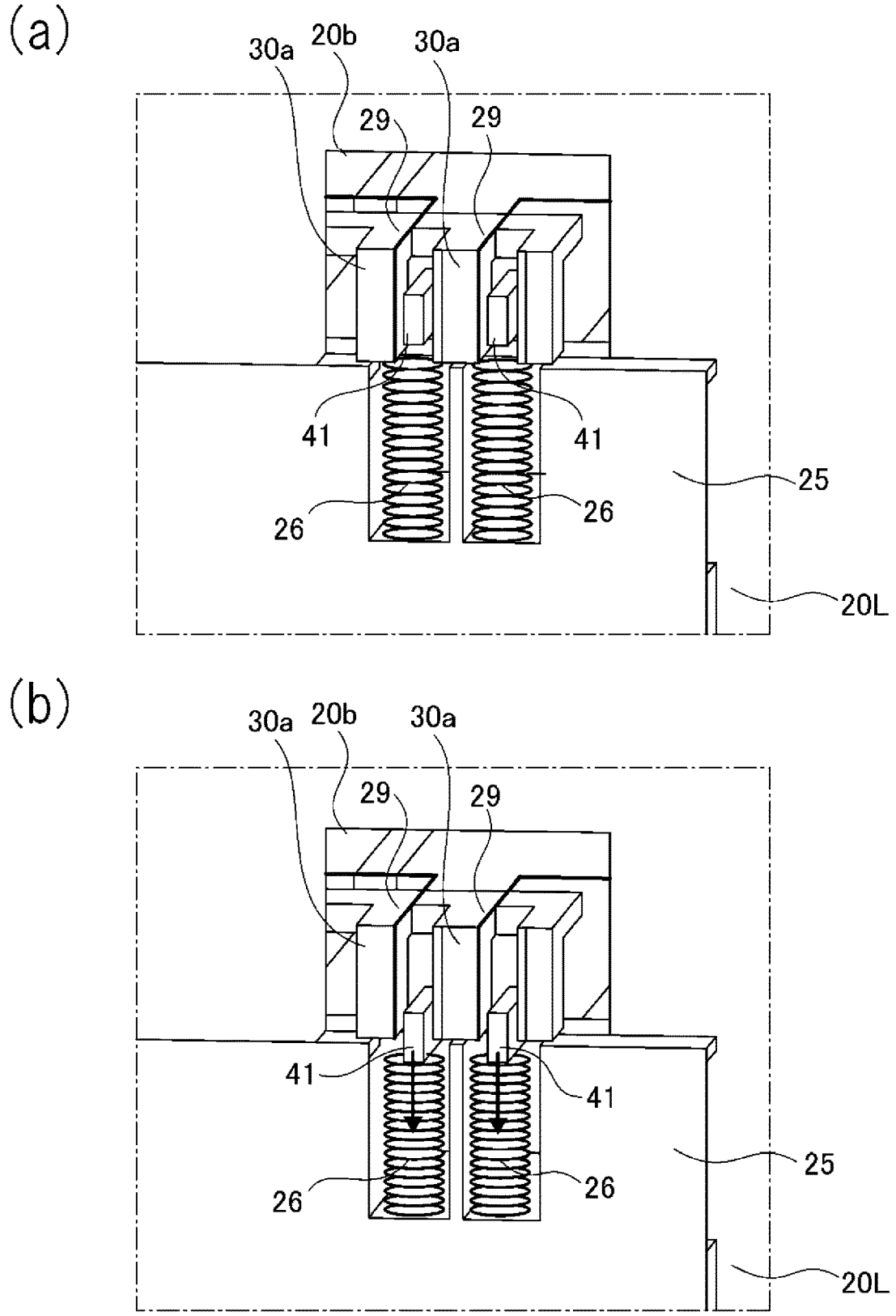

Part (a) of FIG. 12 and part (b) of FIG. 12 are perspective views of the intermediary contact springs, and their adjacencies, in the second embodiment, when the intermediary contact springs are in contact, and are not in contact, respectively, with the connective lines.

Figure 13:
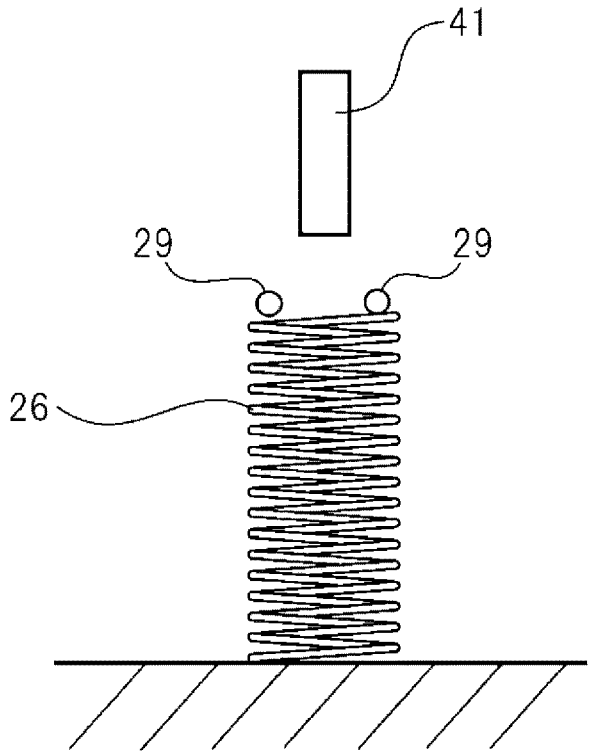
Figure 13:
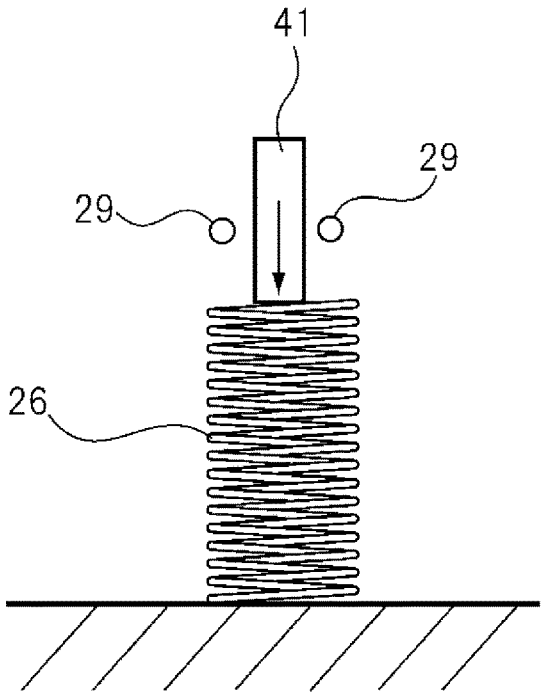

Part (a) of FIG. 13 and part (b) of FIG. 13 are schematic views of a combination of the intermediary contact spring, connective lines, cartridge tray linking member of the image forming apparatus in the second embodiment, when the intermediary contact spring is in contact, and is not in contact, respectively, with the connective lines.

Figure 14:
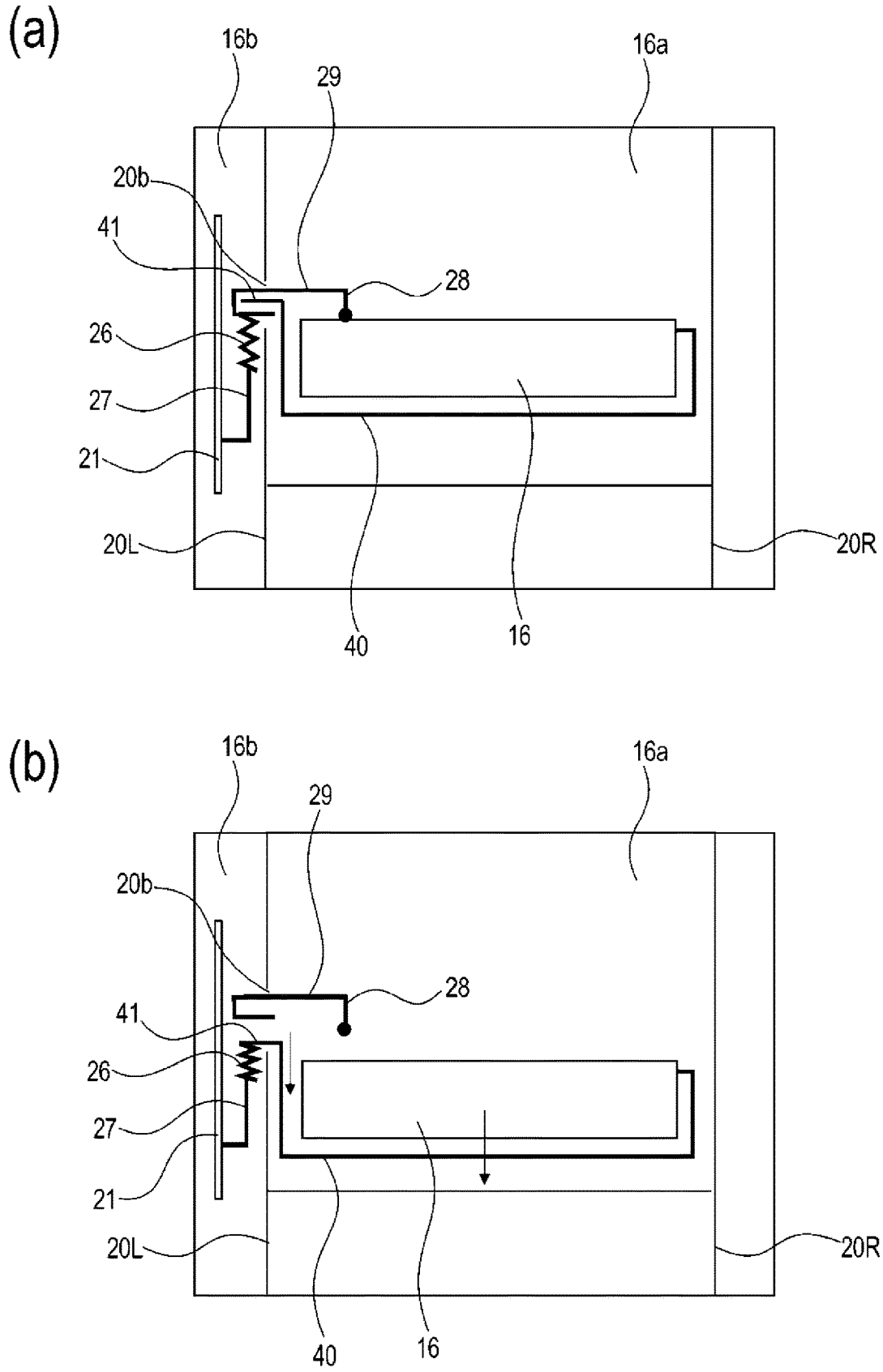

Part (a) of FIG. 14 and part (b) of FIG. 14 are schematic views of one of the intermediary contact springs, and its adjacencies, in the second embodiment, when the intermediary contact spring is in contact, and is not in contact, respectively, with the connective lines, respectively.

DESCRIPTION OF THE EMBODIMENTS

The present invention will be described in detail with reference to a couple of the best embodiments of the present invention. However the measurements, materials, and shapes of the structural components of the image forming apparatuses in the following embodiments of the present invention, and the positional relationship among the structural components, are to be changed as necessary according to the structure of the apparatus to which the present invention is applied, and the various conditions under which the present invention is applied. That is, the following embodiments are not intended to limit the present invention in scope.

Embodiment 1

(Overall Structure of Image Forming Apparatus)

Figure 1:
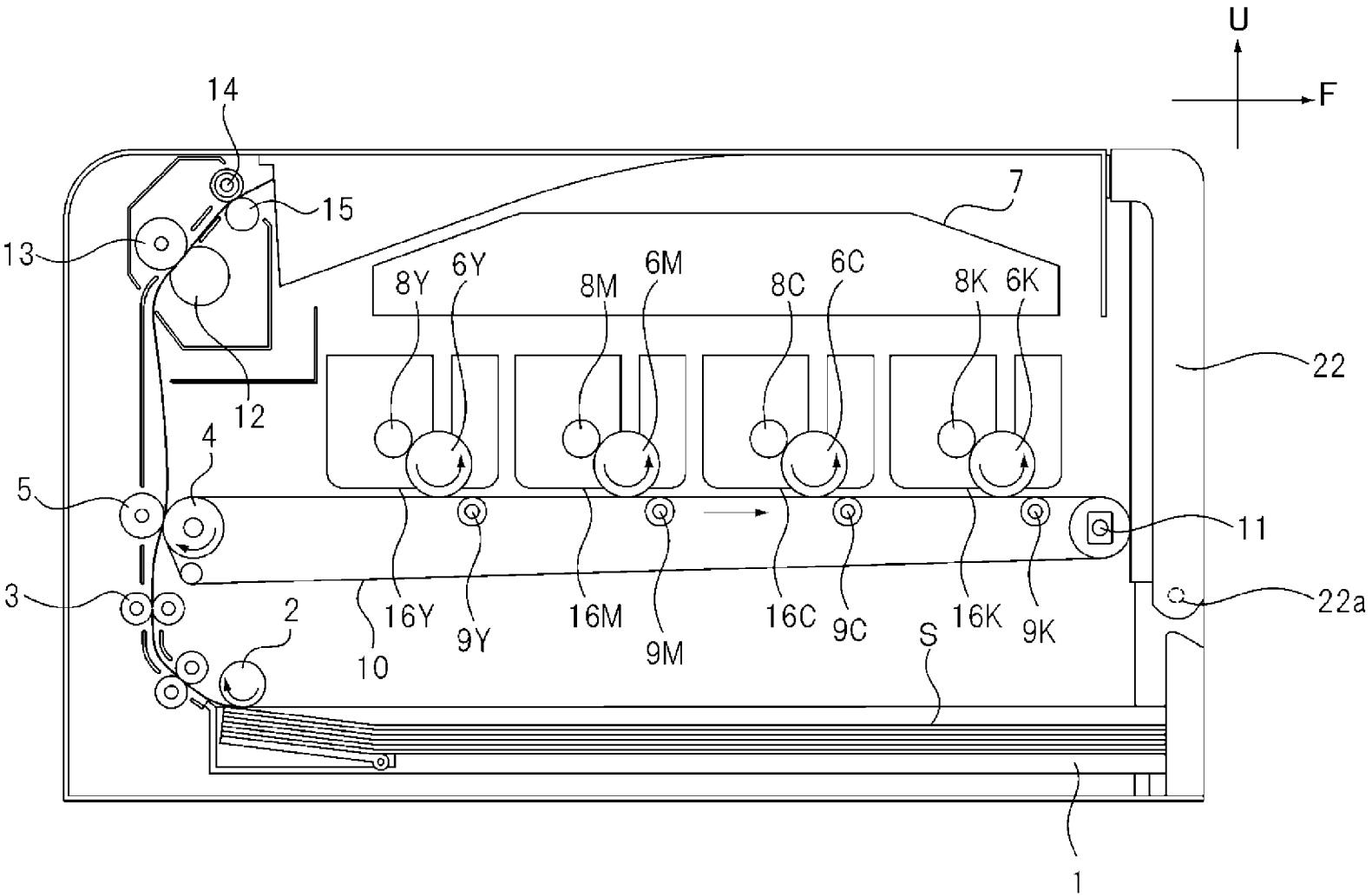
FIG. 1 is a sectional view of the image forming apparatus in the first embodiment of the present invention.

First, referring to FIG. 1, the image forming apparatus in this embodiment is described about its overall structure. FIG. 1 is a sectional view of the image forming apparatus in the first embodiment of the present invention.

The sheets S of recording medium stored in layers in a sheet feeder tray are fed one by one into the main assembly of the image forming apparatus by a feed roller 2 which rotates in the clockwise direction in FIG. 1, and then, is delivered to a pair of conveyance rollers 3. Then, each sheet S is sent to the nip between a driving roller 4 which is on the inward side of the loop (belt loop) which an intermediary transfer belt 10 forms, and a secondary transfer roller 5. Photosensitive drums 6Y, 6M, 6C and 6K, which are image bearing members, and are structural components of the image forming portion of the image forming apparatus, rotate in the counterclockwise direction in FIG. 1. In each of the image forming portions, an electrostatic latent image is formed on the peripheral surface of its photosensitive drum by a beam of laser light from a laser scanner 7. Then, the electrostatic latent image is developed by a development roller 8 (8Y, 8M, 8C or 8K) into a toner image. Then, the toner images formed on the photosensitive drums 6Y, 6M, 6C and 6K, one for one, are sequentially transferred in layers onto the intermediary transfer belt 10, by the pressure and voltage applied by primary transfer units 9Y, 9M, 9C and 9K, respectively. The intermediary transfer belt 10 is an endless belt. It is suspended and tensioned by a drive roller 4, which is on the inward side of the aforementioned belt loop, a tension roller 11, etc. As the drive roller 4 is rotationally driven in the clockwise direction in FIG. 1, the intermediary transfer belt 10 moves at roughly the same speed as the peripheral surface of each photosensitive drum 6.

In a case where a multicolor image is formed, yellow, magenta, cyan, and black toner images are formed on the photosensitive drums 6Y, 6M, 6C and 6K, respectively, and are sequentially transferred onto the intermediary transfer belt 10 by the primary transfer units 9Y, 9M, 9C and 9K, respectively. Then, the toner images on the intermediary transfer belt 10 are transferred together onto the sheet S of recording medium sent to the nip between the driver roller 4, which is on the inward side of the belt loop, and the secondary transfer roller 5. After the transfer of the toner images onto the sheet S, the sheet S is sent to the nip between a heating unit 12, and a pressure roller 13, in which they are heated and pressed. Consequently, the toner images become fixed to the sheet S. After the fixation of the toner images to the sheet S, the sheet S is discharged by a combination of a discharge roller 14 and a follower roller 15.

The image forming apparatus described above is provided with a front door 22, which is such a member of the image forming apparatus that can be opened or closed. The front door 22 is attached to the main assembly of the image forming apparatus in such a manner that it can be pivotally moved relative to the main assembly of the image forming apparatus. More specifically, the front door 22 is pivotally movable about a preset point (pivot 22*a*). It is enabled to take an open position (shown in FIG. 5) in which it exposes an opening 18, with which the main assembly of the image forming apparatus is provided, and a closed position (shown in FIG. 2), in which it keeps the opening closed. As the front door 22 is opened, it becomes possible for a user (operator) to access the interior of the image forming apparatus.

The image forming apparatus described above employs image formation cartridges 16Y, 16M, 16C and 16K, each of which is removably installable in the main assembly of the image forming apparatus, and comprises a photosensitive drum 6 (6Y, 6M, 6C or 6K), a development roller 8 (8Y, 8M, 8C or 8K), and a cartridge in which the photosensitive drum 6 and development roller 8 are integrally disposed. The multiple (four) image formation cartridges (which hereafter will be referred to simply as "cartridge") are removably held by a tray (unshown) which can be drawn out of, or pushed back into, the main assembly of the image forming apparatus. Further, the image forming apparatus is provided with a pair of plates, more specifically, a left plate 20L and a right plate 20R, which are within the main assembly of the image forming apparatus, being positioned so that they oppose each other with the presence of a first space 16*a* between them (part (a) of FIG. 9 and part (b) of FIG. 9). The aforementioned tray is moved into, or pulled out of, the first space in the image forming apparatus.

As the front door 22 is opened, it becomes possible for the tray to be pulled out of the image forming apparatus through the opening 18 (FIG. 5) to replace the cartridges in the image forming apparatus. The cartridges cab be installed into the image forming apparatus by placing the cartridges in the tray, moving the tray into the image forming apparatus through the opening 18 (FIG. 5), and closing the front door 22.

In the following description of the image forming apparatus, the "front side" of the image forming apparatus means the side to which the pivotally movable front door 22 is attached. The "rear side" means the opposite side from the front side. Further, the "left and right sides" of the image forming apparatus means the left and right side of the image forming apparatus as the image forming apparatus is seen from the front side. Further, the left and right sides of the image forming apparatus mean the left and right sides of the image forming apparatus as the image forming apparatus seen from the front side. Moreover, the "top and bottom sides" of the image forming apparatus mean the top and bottom sides of the image forming apparatus, when the apparatus is seen the front side of the apparatus. That is, the upwardly facing side of the image forming apparatus is the top side, and the opposite side from the upwardly facing side is the bottom side of the image forming apparatus.

(Structure of Electrical Contact)

Figure 2:
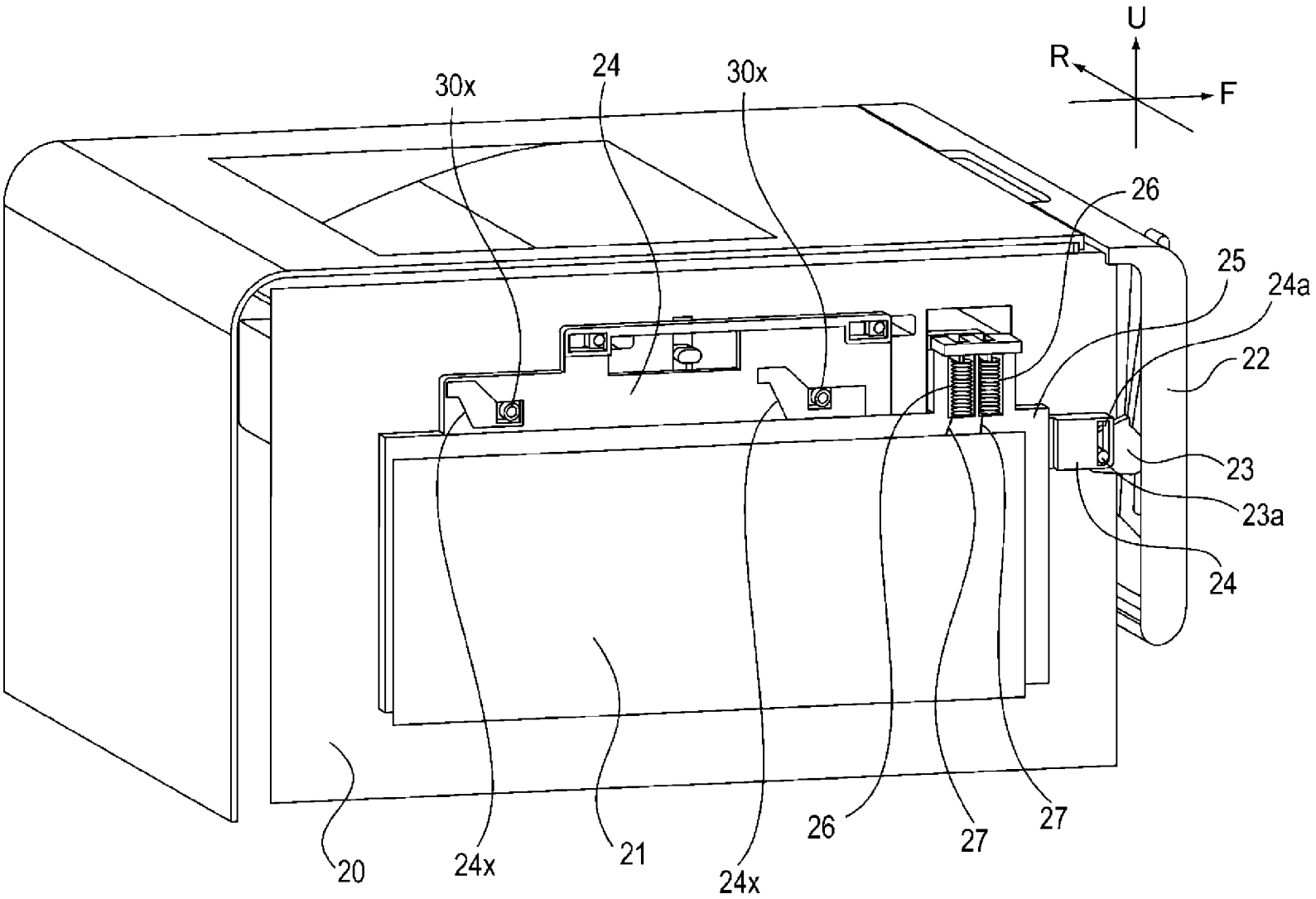
FIG. 2 is a perspective view of the image forming apparatus in the first embodiment, when the front door of the apparatus is remaining closed.
Figure 3:
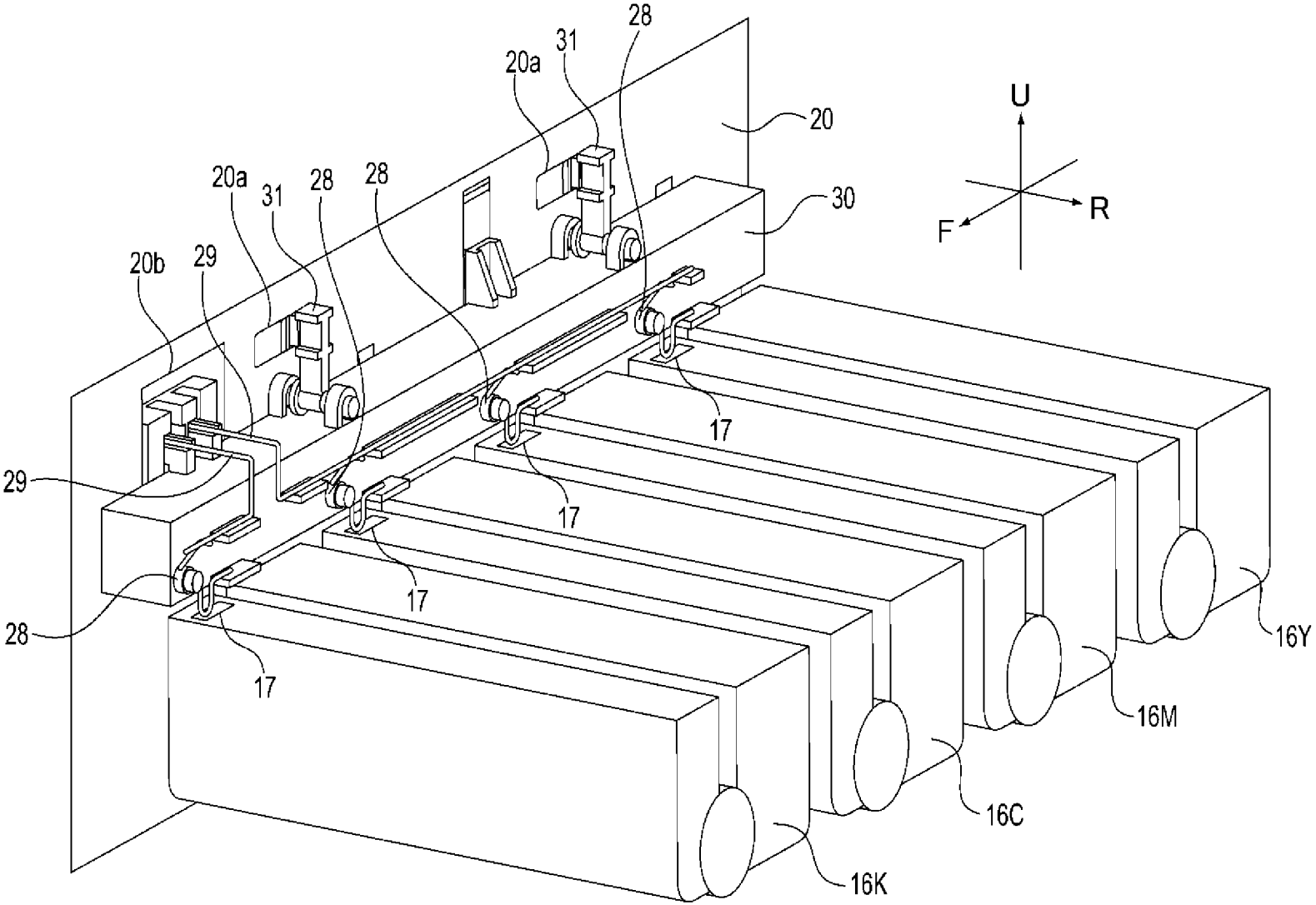
FIG. 3 is also a perspective view of the image forming apparatus in the first embodiment, when the front door of the apparatus is remaining closed.
Figure 4:
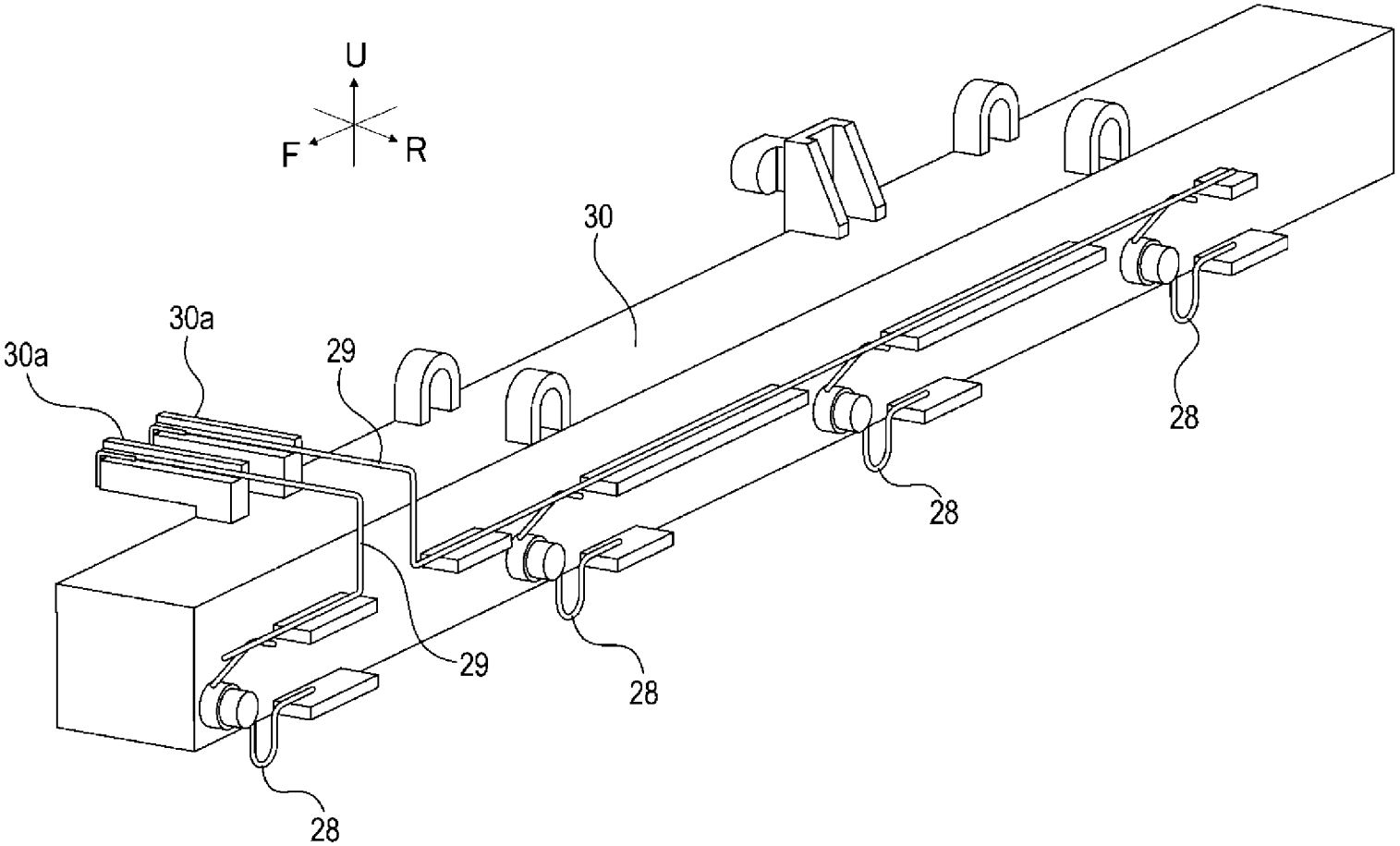
FIG. 4 is a perspective view of the contact spring holder in the first embodiment.

Next, referring to FIGS. 2-4, the electrical contacts, which are around the electric power circuit board in the image forming apparatus, are described about their structure. FIGS. 2 and 3 are perspective views of the image forming apparatus in this embodiment when the front door 22 of the apparatus is remaining closed, that is, when the contacts on the main assembly side are in contact with the corresponding ones on the image formation cartridge side. FIG. 4 is a perspective view of a contact holder 30.

There is provided within the image forming apparatus, an electrical power circuit board 21 for supplying such an object as an image formation cartridge that needs to be supplied with electric power during an image forming operation. The electrical power circuit board 21 is positioned in the space (second space) between the left plate 20L and an unshown left external plate of the image forming apparatus. In the image forming apparatus, the first space 16*a*, in which cartridges are placed, is partitioned from the second space 16*b*, in which the electrical power circuit board 21 is disposed, by the left plate 20L, which functions as a partitioning member (part (a) of FIG. 9 and part (b) of FIG. 9). The left plate 20L is one of the aforementioned pair of plates of the frame of the image forming apparatus. It is grounded.

The electrical power circuit board 21 is in connection to a pair of intermediary contact springs 26, and a pair of circuit board contacts 27 (part (a) of FIG. 8 and part (b) of FIG. 8). The intermediary contact spring 26 is the second electrically conductive member, which is connected to the first electrically conductive member. It is in the form of a compression spring, and is held to an intermediary contact spring holder 25, being in contact with the circuit board contact 27. The circuit board contact 27 is in connection to the electrical power circuit board 21 by its opposite end portion from its end portion which is in contact with the intermediary contact spring 26 (part (a) of FIG. 8 and part (b) of FIG. 8), having thereby electrical connection to the electrical power circuit board 21. By the way, in this embodiment, the second electrically conductive member is made up of the intermediary contact spring 26 and circuit board contact 27, which are physically independent from each other. This setup, however, is not intended to limit the present invention in scope. For example, the present invention is also compatible with a contact spring, the intermediary contact spring 26 and circuit contact 27 of which are integral.

Also provided in the image forming apparatus is a contact holder 30, which is a holding member. The contact holder 30 holds a connective line 29, which is the first conductive member, and a cartridge contact spring 28. The cartridge contact spring 28 is in the form of a torsional coil spring. One of its ends is in contact with one end of the connective line 29. The other end of the cartridge contact spring 28 serves as the contact on the main assembly side, which is connected to a cartridge contact 17, which is the electrical contact on the cartridge 16 side. The other end of the connective line 29 is attached to the contact holder 30 in such a manner that it extends along a rib 30*a*, which is an interactive portion of the rib 30*a*, with which the contact holder 30 is provided. It extends in such a manner that it extends from the top side of the rib 30*a*, wraps around the rib 30*a*, and further extends to the point at which it contacts the intermediary contact spring 26. The rib 30*a*, which is an interactive portion of the rib 30*a*, is positioned so that it protrudes into the second space 16*b* (part (a) of FIG. 9 and part (b) of FIG. 9) through a through hole 20*b*, with which the left plate 20L is provided. The connective line 29 attached to this rib 30*a* functions as an intermediary contact which comes into contact with the intermediary contact spring 26 in the second space.

Figure 6:
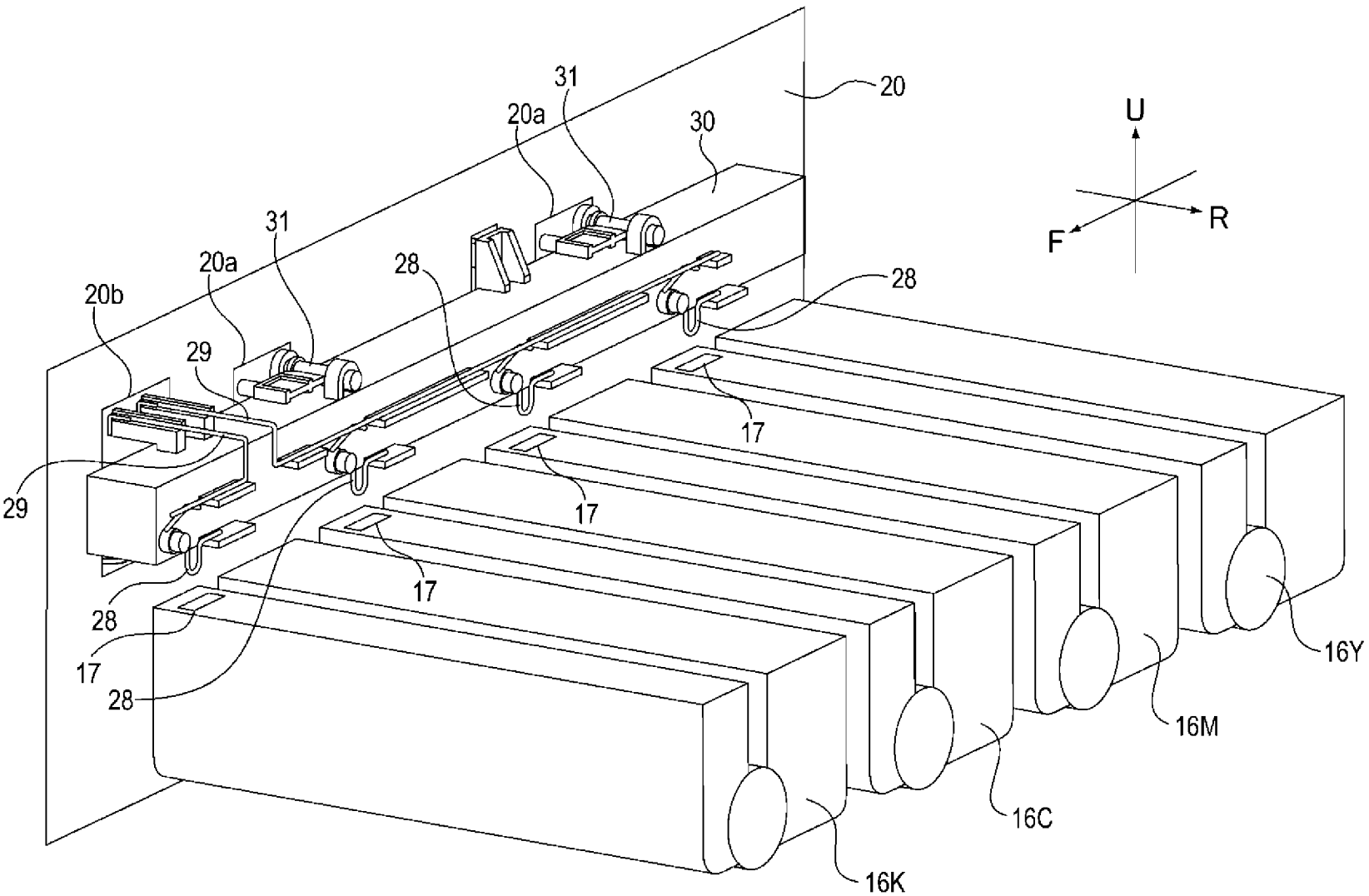
FIG. 6 is also a perspective view of the image forming apparatus in the first embodiment, when the front door of the apparatus is open.

The contact holder 30 has a cylindrical portion 30*x*, which is guided by a rectangular hole 20*x* (part (a) of FIG. 8 and part (b) of FIG. 8), with which the left plate 20L is provided to allow the cylindrical portion 30*x* to vertically move. That is, the contact holder 30 is allowed to vertically move, with its cylindrical portion 30*x* being guided by the rectangular hole 20*x*. The contact holder 30 which is movable member is allowed to move into a contact position (FIG. 3) in which it keeps the cartridge contact spring 28 in contact with the contact 17 of a cartridge, or a no-contact position in which it keeps the cartridge contact spring 28 separated from the cartridge contact 17 (FIG. 6).

The contact holder 30 rotatably held by one of the end portions of a cartridge pressing member 31. The other end portion of the cartridge pressing member 31 is supported by the wall of the rectangular hole 20*a* with which the left plate 20L is provided to allow the contact holder 30 to move in the front-rear direction. The contact holder 30 is supported by the cartridge pressing member 31 so that it is allowed to move relative to the left plate 20L.

The contact holder 30 is connected to the front door 22 by a linking mechanism which comprises a pair of linking members 23 and 24. The first linking member 23 is connected to the front door 22 by one of its end portions, so that it is pivotally movable relative to the front door 22. The other end portion of the first linking member 23 is provided with a boss 23*a*. The second linking member 24 is supported by the main assembly of the image forming apparatus in such a manner that it is movable in the front-rear direction. Its frontal end portion is provided with a long hole 24*a*, in which the boss 23*a* of the first linking member 23 is fitted. Further, the second linking member 24 is provided with a slant surface 24*x*, the front end of which is lower than its rear end. The main assembly of the image forming apparatus is designed so that the slant surface 24*x* of the second linking member 24 engages with the cylindrical portion 30*x* of the contact holder 30, which is guided by the wall of the vertical rectangular hole 20*x* of the left plate 20L.

Therefore, as the front door 22 is opened, the second linking member 24 is moved frontward by the front door 22. Thus, the cylindrical portion 30*x* of the contact holder 30 is moved upward by the slant surface 24*x*, while being guided by the rectangular hole 20*x* of the left plate 20L. On the other hand, as the front door 22 is closed, the second linking member 24 is moved rearward. Consequently, the cylindrical portion 30*x* of the contact holder 30 is moved downward by the slant surface 24*x* while being guided by rectangular hole 20*x* of the left plate 20L.

Figure 5:
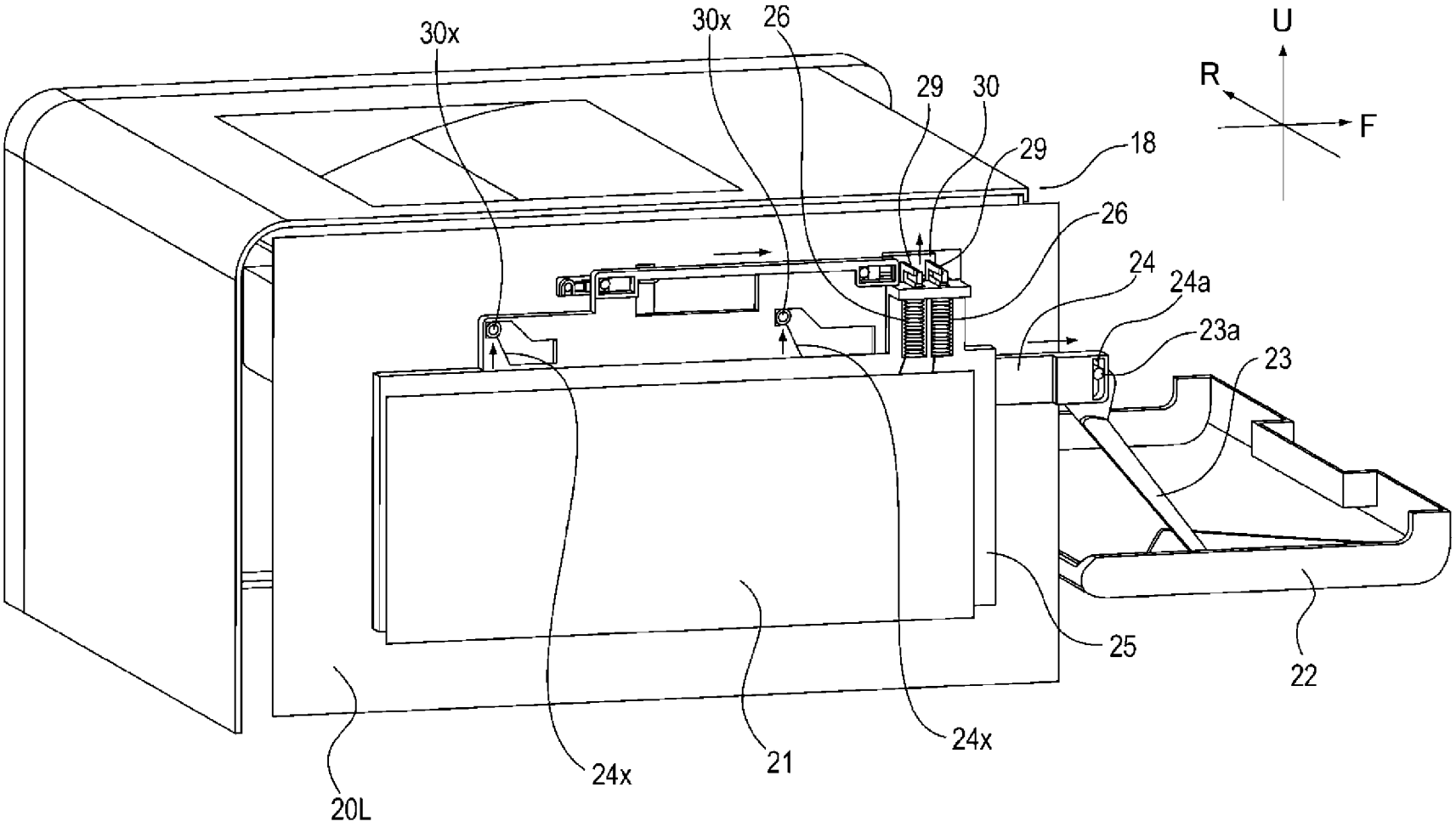
FIG. 5 is a perspective view of the image forming apparatus in the first embodiment, when the front door of the apparatus is open.

Next, referring to FIGS. 5-9, the mechanism for separating the electrical contacts on the main assembly side from the corresponding electrical contacts on the cartridge side as the front door is opened is described in detail about its structure. FIGS. 5 and 6 are perspective views of the image forming apparatus when the front door 22 is open, that is, when the electrical contacts on the main assembly side are not in contact with the corresponding electrical contacts of the cartridges. FIG. 7 is a schematic side view of the portions of the image forming apparatus in the first embodiment, which are closely related to the present invention. It shows what occurs to the related portions as the front door 22 is opened. Part (a) of FIG. 7 shows the state of the related portions when the front door 22 is remaining closed. Part (b) of FIG. 7 shows the related portions while the front door 22 is opened. Part (c) of FIG. 7 shows the portions when the front door 22 is open. Part (a) of FIG. 8 and part (b) of FIG. 8 are perspective views of the related portions when the electrical contacts on the main assembly side are in contact with the counterparts on the cartridge side, and are not, respectively. FIG. 7 is a schematic sectional view of one of the pair of intermediary contact springs 26, and its adjacencies. Part (a) of FIG. 7, part (b) of FIG. 7 and part (c) of FIG. 7 shows the portions of the image forming apparatus, which are closely related to the present invention, when the front door 22 is remaining closed, is being opened, and is open, respectively. FIG. 8 is a perspective view of the intermediary contact springs, and its adjacencies, in the first embodiment, part (a) of FIG. 8 and part (b) of FIG. 8 showing the intermediary contact springs when the springs are in contact with, and are not in contact with, the contacts on the cartridge side. Part (a) of FIG. 9 and part (b) of FIG. 9 are schematic sectional views of one of the intermediary contact springs, and its adjacencies, of the image forming apparatus in the first embodiment, when the intermediary contact spring is in contact, and is not in contact, respectively, with the connective line.

Next, the separation of the electrical contact on the main assembly side from the counterparts on the cartridge side, which occurs as the front door 22 is opened, and the connection of the former to the latter, which occurs as the front door 22 is closed, are described. Referring to part (a) of FIG. 7 and part (a) of FIG. 8, when the front door 22 is remaining closed, the contact connection line 29 on the contact holder side, and the intermediary contact spring 26 on the electric power circuit board side, are in connection to each other, and therefore, there is electrical connection between the contact connection line 29 and intermediary contact spring 26. By the way, when the front door 22 is remaining closed, the cartridges held in the tray (unshown) are in the main assembly of the image forming apparatus. Therefore, the cartridge contact spring 28 of the contact holder 30 is in contact with the cartridge contact 17 of the cartridge, and therefore, there is electrical connection between the contact holder 30 and cartridge (FIG. 3). Therefore, it is possible to supply the cartridge 16, which is an object to be supplied with electric power, with electric power from the electrical power circuit board 21 in the image forming apparatus.

Referring to part (b) of FIG. 7, as the front door 22 is pivotally moved about the pivot 22*a* while there is electrical connection between the cartridges and the main assembly of the image forming apparatus, the first linking member 23 is pivotally moved by the front door 22, and therefore, the second linking member 24 which is in connection to the first linking member 23 moves toward the front side of the image forming apparatus. As the second linking member 24 moves frontward, the cylindrical portion 30*x* of the contact holder 30 is moved upward by the slant surface 24*x* while being guided by the rectangular hole 20*x* of the left plate 20L. Next, referring to part (c) of FIG. 7, part (b) of FIG. 8 and part (b) of FIG. 9, as the contact holder 30 moves upward, the contact connection line 29 held to the contact holder 30 separates from the intermediary contact spring 26 held by the intermediary contact spring holder 25 of the electrical power circuit board 21. During this action, the top end portion of the intermediary contact spring 26 comes into contact with the intermediary contact spring holder 25, and is pressed. Therefore, it remains compressed.

Similarly, the cartridge contact spring 28 moves upward with the contact holder 30, and therefore, is separated from the cartridge contact 17 which is the electrical contact portion of the cartridge 16. As the cartridge contact spring 28 is separated from the cartridge 16, it becomes possible for the tray (unshown), which is holding the cartridges 16, to be pulled out of the main assembly of the image forming apparatus, on the front side of the apparatus, and therefore, it becomes possible for a user to take the cartridges 16 out of the main assembly.

Further, as the contact holder 30 is moved to the point of separation, the contact connection line 29 attached to the rib 30*a* of the contact holder 30 comes into contact with the left plate 20L, as show in part (b) of FIG. 9, to make it easier for static electrical charge to escape to prevent static electricity discharge. Therefore, the contact connection line 29 attached to the contact holder 30 becomes separated from the electrical contact of the cartridge 19, and the contacts of the electric power circuit board, and is grounded through the left plate 20.

By the way, the image forming apparatus is provided with a pair of contact connection lines 29, each of which is in connected to the cartridge contact spring 28 having the electrical contact of each cartridge, a pair of intermediary contact springs 26 which are connected to the contact connection lines 29, and a pair of circuit board contacts 27 which are in connection to the intermediary contact springs 26, one for one. This setup is for separating the electrically conductive passage, through which electric power is supplied to the color (yellow, magenta and cyan) image formation cartridges, from the electrically conductive passage through which electrical power is supplied to the monochromatic (black) image formation cartridge. In this embodiment, therefore, the image forming apparatus is provided with the interactive portion which interrupts the electrically conductive passage from the electric power circuit board to the cartridge contact spring on the color side, and the interactive portion which interrupts the electrically conductive passage from the electric power circuit board to the cartridge contact spring.

Referring to part (b) of FIG. 8 and part (b) of FIG. 9, with the separation mechanism being structured as described above, the contact connection line 29 on the contact holder side remains separated from the intermediary contact spring 26 which is in connection to the electrical power circuit board 21. Therefore, it does not occur that static electricity is discharged to the electrical power circuit board 21. Thus, this embodiment of the present invention can substantially reduce the electrical power circuit board 21 in its possibility that it will be damaged by the static electric discharge. Further, as the contact connection line 29 is separated from the intermediary contact spring 26, it comes into contact with the left plate 20L which is grounded. Therefore, even if static electricity flows from the cartridge contact spring 28 to the contact connection line 29, it does not flow from the contact connection line 29 to the electrical power circuit board 21.

Further, while the front door 22 is opened, the circuit board contact 27 and intermediary contact spring 26, which are in contact with the electrical power circuit board 21, are in the second space which is partitioned from the first space for the cartridges 19, by the left plate 20L. That is, they are in a space which cannot be accessed by a user. Thus, it is unnecessary for the image forming apparatus to be provided with a safety switch such as an interlock switch.

Embodiment 2

Next, the image forming apparatus in the second embodiment of the present invention is described. By the way, the general structure of the image forming apparatus in this embodiment is similar to that of the image forming apparatus in the first embodiment. Therefore, the members of the image forming apparatus in this embodiment, which are similar in function to the counterparts in the first embodiment, are given the same referential codes as those given to the counterparts, and are not described.

In the first embodiment, the image forming apparatus was structured so that as the front door 22 is opened or closed, the contact holder 30 which is holding the contact connection line 29 and cartridge contact spring 28 is moved upward, or downward, respectively, by the movement of the front door 22. The first embodiment, however, is not intended to limit the present invention in scope. In the second embodiment of the present invention, the image forming apparatus is structured so that as the front door 22 is opened or closed, a cartridge tray 40, which is a member for holding the cartridges 16, is moved upward or downward, respectively, by the movement of the front door 22.

Referring to FIGS. 10-14, the electrical contacts in the adjacencies of the electrical power circuit board in the image forming apparatus are described about their structure. FIG. 10 is a perspective view of the interior of the image forming apparatus when the front door of the image forming apparatus is remaining closed, that is, when the electrical contacts on the image forming apparatus side are in contact with the corresponding electrical contacts on the cartridge side, respectively. FIG. 11 is a perspective view of the interior of the image forming apparatus in the second embodiment, when the front door of the image forming apparatus is open, that is, when the electrical contacts on the image forming apparatus side are remaining separated from the counterparts of the cartridges, respectively. FIG. 12 is a perspective view of the intermediary contact springs, and their adjacencies, in this embodiment, part (a) of FIG. 12 and part (b) of FIG. 12 representing the state of the intermediary contact springs, in which the intermediary contact springs are in contact with their counterparts, and that in which the intermediary contact springs are not, respectively. FIG. 13 is a schematic drawing of a combination of one of the intermediary contact springs, in the second embodiment, part (a) of FIG. 13 and part (b) of FIG. 13 showing the state of the combination when the electrical contacts on the main assembly side are in contact with, and are not in contact with, respectively, the counterparts on the cartridge side. Part (a) of FIG. 14 and part (b) of FIG. 14 are schematic views of one of the intermediary contact springs, and its adjacencies, in the second embodiment, when the intermediary contact spring is in contact, and is not in contact, respectively, with the connective lines.

There is provided in the image forming apparatus, an electric power circuit board 21 for supplying an object such as an image formation cartridge in the image forming apparatus with electric power necessary during image formation. The electric power circuit board 21 is positioned in a space between the left plate 20L and the left external wall (unshown). In the image forming apparatus, the first space 16*a* for cartridges is partitioned from the second space 16*b* for the electric power circuit board 21 by the left plate 20L which is functioning as a partitioning member (part (a) of FIG. 14 and part (b) of FIG. 14). The left plate 20L is one of the aforementioned pair of frame members (left plate 20L and right plate 20R). The left plate 20L is grounded.

The electric power circuit board 21 is in connection to the intermediary contact spring 26 and an electric power circuit board contact 27. The intermediary contact spring 26 is the electrically conductive second member which is connected to the electrically conductive first member. The intermediary contact spring 26 is a compression spring. It is held by the intermediary contact spring holder 25, being in contact with the electric power circuit board contact 27. The electric power circuit board contact 27 is in connection to the electric power circuit board 21 by its opposite end from the one which is in contact with the intermediary contact spring 26, having thereby electrical connection to the electric power circuit board 21. By the way, in this embodiment, the electrically conductive second member comprises the intermediary contact spring 26 and electric power circuit board contact 27, which are physically independent from each other. This embodiment, however, is not intended to limit the present invention in scope in terms of the composition of the second electrically conductive member. For example, the present invention is also compatible with such a contact spring that is an integral combination of the intermediary contact spring 26 and electric power circuit board contact 27.

There is provided the contact holder 30 in the image forming apparatus. The contact holder 30 holds the contact connection line 29 as the first electrically conductive member, and the cartridge contact spring 28. The contact holder 30 is fixed to a preset position in the image forming apparatus. The cartridge contact spring 28 is in the form of a torsion spring. One end of the cartridge contact point spring 28 is in contact with one end of the contact connection line 29. The other end of the cartridge contact spring 28 serves as the main assembly contact, which is connected to the cartridge contact 17, which is the electrical contact which the cartridge 16 has. The other end portion of the contact connection line 29 is held to the contact holder 30 in such a manner that it extends along the rib 30, with which the contact holder 30 is provided, wraps around the top edge of the rib 30*a*, and extends further to the intermediary contact spring 26. The rib 30*a* is positioned so that it protrudes into the second space 16*b* (part (a) of FIG. 14 and part (b) of FIG. 14) through a through hole 30*b* with which the left plate 20L is provided.

There is also provided in the image forming apparatus, a cartridge tray linking member 41 which is enabled to vertically move. The cartridge tray linking member 41 is positioned so that it is protrusive into the second space 16*b* (part (a) of FIG. 14 and part (b) of FIG. 14), through the through hole with which the left plate 20L is provided. The cartridge tray linking member 41 is engaged with the cartridge tray 40 in such a manner that the engaging portion

40*a* as an interactive portion, with which the cartridge tray 40 is provided, is movable in the front-rear direction. Therefore, the cartridge tray linking member 41 vertically moves with the cartridge tray 40 which is a movable member, causing thereby the intermediary contact spring 26, to come into contact with, or separate from, the contact connection line 29 held by the contact holder 30.

By the way, although it is not illustrated, the cartridge tray 40 is supported in such a manner that it is movable relative to the main assembly of the image forming apparatus in the front-rear direction. Further, the image forming apparatus is structured so that as the front door 22 is opened or closed, the cartridge tray 40 is vertically moved by the movement of the front door 22 through the linkage. Next, these structural arrangements are sequentially described about their structure.

The cartridge tray 40 is supported by the guiding members (unshown) provided within the image forming apparatus, in such a manner that it is movable in the front-rear direction. Each guiding member has a cylindrical portion which is guided by the rectangular hole (unshown) which allows the cylindrical portion to vertically move relative to the left plate 20L (or right plate 20R), which is one of the members of the frame. That is, with the cylindrical portion of the guiding member being fitted in the rectangular hole as described above, the guiding member is allowed to vertically move like the contact holder 30 in the first embodiment described above.

The afore-mentioned guiding members (unshown) which guide the cartridge tray 40 in the front-rear direction are connected to the front door 22 by the linkage mechanism which comprises multiple linking members (unshown), like the contact holder 30 in the first embodiment described above. The first linking member (unshown) is in connection to the front door 22 by one end in such a manner that it is allowed to pivotally move. The other end, or the front end, of the second linking member is in connection to the other end of the first linking member. Further, the second linking member has a slant surface (unshown), the front end of which is higher than the rear end. The second linking member is positioned so that its slant surface engages with the cylindrical portion of the aforementioned guiding member which is guided by the vertical rectangular hole with which the left plate 20L is provided.

Therefore, as the second linking member is moved frontward by the opening of the front door 22, the cylindrical portion of the aforementioned guiding member is moved downward by the slant surface while being guided by the rectangular hole of the left plate 20L. On the other hand, as the second linking member is moved rearward by the closing of the front door 22, the cylindrical portion of the aforementioned guiding member is moved upward while being guided by the rectangular hole of the left plate 20L.

Next, referring to FIGS. 10-14, the separation of the electrical contacts of the cartridge from the counterparts of the main assembly of the image forming apparatus, and the contacting of the electrical contacts of the cartridge with the counterparts of the main assembly, which are caused by the opening and closing, respectively of the front door 22, are described in detail.

Referring to part (a) of FIG. 12, part (a) of FIG. 13 and part (a) of FIG. 14, when the front door 22 is remaining closed, the contact connection line 29 of the contact holder 30 remains in contact with the intermediary contact spring 26 of the electric power circuit board 21, and therefore, there is electrical connection between the contact connection line 29 and intermediary contact spring 26. Further, when the front door 22 is remaining closed, the cartridge tray linking member 41 is not in contact with the top end of the intermediary contact spring 26. However, the top end of the intermediary contact spring 26 is in contact with the rib 30*a* of the contact holder 30, being thereby pressed by the rib 30*a*, and therefore, remains compressed. By the way, when the front door 22 is remaining closed, the cartridges held in the tray (unshown) remain installed in the image forming apparatus. Therefore, the cartridge contact spring of the contact holder 30 and electrical contact of the cartridge are also in contact with each other, providing thereby electrical connection between the contact holder 30 and cartridge. Therefore, the electric power circuit board 21 in the image forming apparatus can supply the cartridge 16, which is an object to be supplied with electric power, with electric power.

As the front door 22 is rotated about its pivot in the direction to be opened while there is electrical connection between the electric power circuit board 21 and cartridge 16, the first linking member (unshown) is pivotally moved by the front door 22. Consequently, the second linking member (unshown) which is in connection to the first linking member moves frontward. As the second linking member moves frontward, the cylindrical portion of the aforementioned guiding member (unshown) is moved downward by the slant surface (unshown) while being guided by the rectangular hole of the left plate 20L. As the guiding member moves downward, the cartridge tray 40 held by the guiding member moves downward, and therefore, the cartridge tray linking member 41 which is in engagement with the cartridge tray engaging portion, also moves downward. As the cartridge tray linking member 41 is moved downward, the intermediary contact spring 26 held by the intermediary contact spring holder 25 of the electric power circuit board 21 is separated from the contact connection line 29 held by the contact holder 30.

Similarly, the cartridge contact 17, which is the electrical contact of the cartridge 16, moves downward with the cartridge tray 40. Therefore, it is separated from the cartridge contact spring 28 held by the contact holder 30. As the cartridge contact 17 is separated from the cartridge contact spring 28, it becomes possible for the cartridge tray 40, which is holding the cartridge 16, to be pulled frontward of the image forming apparatus. Therefore, it becomes possible for a user to take the cartridge 16 out of the cartridge tray 40.

By the way, the contact connection line 29 which is in connection to the cartridge contact spring 28 having the electrical contact of each cartridge, intermediary contact spring 26 which is to be connected to the contact connection line 29, circuit board contact 27 which is in connection to the intermediary contact spring 26, are provided by a pair, in order to separate the electrically conductive power passage to the color (yellow, magenta, and cyan) cartridge from the one to the monochromatic (black-and-white) cartridge. In this embodiment, therefore, the contact holder 30 is provided with the rib 30*a*, as interactive portion, which is capable of interrupting the electric power passage from the electric power circuit board to the cartridge contact spring on the color side, and the rib 30*a*, as an interactive portion, (cartridge tray linking member 41 which is in engagement with engaging portion 40*a* of the cartridge tray 40) which is capable of interrupting the electric power passage from the electric power circuit board to the cartridge contact spring on the monochromatic side.

Referring to part (b) of FIG. 12, part (b) of FIG. 13 and part (b) of FIG. 14, with the provision of the separation structure described above, the intermediary contact spring 26 which is in connection to the electric power circuit board 21 is not in contact with the contact connection line 29 on the contact holder 30 side. Therefore, the ESD (electrostatic discharge) does not conduct to the electric power circuit board 21. Thus, this embodiment also reduces the electric power circuit board 21 in the possibility of being damaged by the ESD.

Further, the circuit contact 27 and intermediary contact spring 26 which are in connection to the electric power circuit board 21 are in the second space partitioned by the left plate 20L from the first space in which the cartridges are to be placed. That is, they are in the area which a user cannot access. Therefore, it is unnecessary to provide the image forming apparatus with a safety switch such as an interlock switch.

[Miscellanies]

In the first embodiment described above, as the rib 30, which is a part of the contact holder 30 which is a moving member, moves into its contact position, it connects the first conductive member on the contact holder 30 side to the second conductive member on the electric power circuit board 21 side, and as it moves into its separation position, it separates the aforementioned first conductive member from the aforementioned second conductive member. These embodiments, however, are not intended to limit the present invention in scope. All that is necessary is that the image forming apparatus is structured so that the portion of the moving member, which moves with the moving member, connects or disconnect the conductive passage between the electrical contact of the conductive member, on the main assembly side, and the electric power circuit board 21, at least one point. That is, the image forming apparatus may be structured so that the portion of the moving member, which moves with the moving member, connects or disconnect the conductive passage between the contact of the conductive member, which is on the main assembly side, and the contact of the electric power circuit board, at two or more points, instead of just one point.

Further, in the embodiments described above, the image forming apparatus was structured so that a cartridge in which a photosensitive drum, and processing means for processing the photosensitive drum are integrally disposed is removably installable in the main assembly of the apparatus. These embodiments, however, are not intended to limit the present invention in scope. For example, the present invention is also applicable to such an image forming apparatus that is structured so that a photosensitive drum, which is an image bearing member, and each of processing means, are individually and removably installable in the main assembly of the image forming apparatus.

Moreover, in the embodiments described above, the image forming apparatus was a printer. These embodiment, however, are not intended to limit the present invention in scope. That is, the present invention is also applicable to other image forming apparatus than a printer. For example, the present invention is applicable to a copying machine, a facsimileing machine, and a multifunction image forming machine capable of functioning as two or more of the preceding image forming apparatuses. Further, in the preceding embodiments, the image forming apparatus was such an image forming apparatus that employs an intermediary transferring member and sequentially transferring toner images, different in color, in layers onto the intermediary transferring member, and then, transfers the toner images on the intermediary transferring member, all together onto a sheet of recording medium. These embodiments, however, are not intended to limit the present invention in scope. That is, the present invention is also applicable to such an image forming apparatus that employs a recording medium bearing member, and sequentially transfers toner images, different in color, in layers onto the recording medium on the recording medium bearing member. Application of the present invention to these examples of image forming apparatus also can provide effects similar to those obtainable by the image forming apparatuses in the first and second embodiments described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-156387 filed on Aug. 29, 2019, which is hereby incorporated by reference herein in its entirety.

What is claimed is:

1. An image forming apparatus comprising:

an opening/closing member provided rotatably relative to a main assembly of said image forming apparatus and movable between an open position for opening a opening provided in said main assembly, and a closing position for closing the opening;

an electric power source substrate configured to supply electric power to an object which is detachably mounted to said main assembly through the opening and which is to be supplied with electric power, wherein the object is provided with an electrical contact;

an electroconductive member provided with a main assembly side contact portion connected with said electric power source substrate;

a movable member movable between a contacting position for contacting said main assembly side contact portion and said electrical contact portion with each other and a spacing position for spacing them from each other;

a link mechanism connecting said opening/closing member and said movable member with each other, said link mechanism being capable of moving said movable member to the contacting position in interrelation with a closing operation of said opening/closing member and capable of moving said movable member to the spacing position in interrelation with and opening operation of said opening/closing member; and an operating portion movable with said movable member moving to the contacting position to connect at least a part of an electroconductive path between said main assembly side contact portion of said electroconductive member and said electric power source substrate, said operating portion being movable with said movable member moving to the spacing position to disconnect at least a put of an electroconductive path between said main assembly side contact portion of said electroconductive member and said electric power source substrate, a separation member dividing inside of said image forming apparatus into a first space to accommodate the object to which the electric power is supplied and a second space in which said electric power source substrate is placed, wherein said movable member is movably provided in the first space, and wherein said operating portion is provided so that said operation portion is projected into the second space through a through-hole provided in said separation member.

2. An image forming apparatus according to claim 1, wherein said electroconductive member includes a first electroconductive member provided with said main assembly side contact portion configured to be connected with said electrical contact portion of the object, and a second electroconductive member connected with said electric power source substrate and with said first electroconductive member, and wherein said operating portion is capable of moving with said movable member moving to the contacting position to connect said second electroconductive member with said second electroconductive member and is capable of moving together with said movable member moving to said spacing position to disconnect said first electroconductive member from said second electroconductive member.

3. An image forming apparatus according to claim 2, wherein said movable member includes a holder member holding said first electroconductive member and provided with said operating portion, said holder member brings said main assembly side contact portion into contact with said electrical contact portion and brings said first electroconductive member into contact with said second electroconductive member, when said holder member is moved to the contacting position, and said holder member separates said main assembly side contact portion from said electrical contact portion and separates said first electroconductive member from said second electroconductive member, when said holder member is moved to the spacing position.

4. An image forming apparatus according to claim 2, further comprising a holder member holding said first electroconductive member and fixed inside said image forming apparatus, a linking member provided in said image forming apparatus so as to be movable to bring said second electroconductive member into and out of contact relative to said first electroconductive member held by said holder member, wherein said movable member is capable of detachably holding the object having said electrical contact portion, and an engaging portion engaged with said linking member as said operating portion, wherein when said holding member moves to the contacting position, said holding member brings said electrical contact portion into contact with said main assembly side contact portion and brings said second electroconductive member into contact with said first electroconductive member, and wherein when said holding member separates said electrical contact portion from said main assembly side contact portion, and separates said second electroconductive member from said first electroconductive member.

5. An image forming apparatus according to claim 1, further comprising a pair of frame members which are opposed to each other with the first space therebetween, and said separation member functions as one of said frame members.

6. An image forming apparatus according to claim 1, wherein said separation member is electrically grounded, wherein when said movable member is moved to the spacing position, said operating portion contacts said separation member, and when said movable member moves to the contacting position, said operating portion separates from said separation member.

7. An image forming apparatus according to claim 1, wherein the object is a cartridge including an image bearing member and said image bearing member.

8. An image forming apparatus according to claim 1, wherein a plurality of such cartridges are mountable to said image forming apparatus, wherein said apparatus further comprises a plurality of such main assembly side contact portions capable of being connected with said electrical contact portions of said cartridge, respectively, and at least one said operating portion connected with said main assembly side contact portions.

* * * * *